US005261498A

United States Patent [19]

Steinkamp et al.

[11] Patent Number: 5,261,498

[45] Date of Patent: Nov. 16, 1993

[54] DRILL STRING COMPONENT

[75] Inventors: Manfred Steinkamp; Werner Lau; Bruce McGarian, all of Aberdeen, United Kingdom

[73] Assignee: The Red Baron (Oil Tools Rental) Limited, Aberdeen, United Kingdom

[21] Appl. No.: 784,392

[22] PCT Filed: Jun. 29, 1990

[86] PCT No.: PCT/GB90/01006

§ 371 Date: Dec. 30, 1991

§ 102(e) Date: Dec. 30, 1991

[87] PCT Pub. No.: WO91/00411

PCT Pub. Date: Jan. 10, 1991

[30] Foreign Application Priority Data

Jun. 29, 1989 [GB] United Kingdom ..... 8914882

[51] Int. Cl.[5] ..... E21B 17/10

[52] U.S. Cl. ..... 175/325.3

[58] Field of Search ..... 175/325.1, 325.2, 325.3, 175/325.4, 325.5, 321, 295, 73

[56] References Cited

U.S. PATENT DOCUMENTS

| | | | |
|---|---|---|---|
| 1,539,096 | 5/1925 | Perry | 175/325.3 |
| 1,737,578 | 12/1929 | Fentress | 175/325.3 |
| 1,756,195 | 4/1930 | Holdaway | 175/325.3 |
| 1,877,395 | 9/1932 | Goeser | 175/325.3 |
| 1,888,216 | 11/1932 | Bull . | |
| 2,815,930 | 12/1957 | Storm . | |
| 2,876,992 | 3/1959 | Lindsay . | |
| 2,919,897 | 1/1960 | Sims . | |
| 3,104,134 | 9/1963 | Nielsen et al. | 175/325.3 |
| 3,109,501 | 11/1963 | Pugh . | |
| 3,352,370 | 11/1967 | Livingston | 175/325.3 |
| 4,071,101 | 1/1978 | Ford | 175/325.3 |
| 4,083,612 | 4/1978 | Olson . | |
| 4,102,552 | 7/1978 | Kellner . | |
| 4,606,417 | 8/1986 | Webb et al. | 175/325.3 |
| 4,757,861 | 7/1988 | Klyne . | |
| 4,989,679 | 2/1991 | Chaffaut | 175/325.3 |

*Primary Examiner*—Ramon S. Britts
*Assistant Examiner*—Frank S. Tsay
*Attorney, Agent, or Firm*—Oblon, Spivak, McClelland, Maier & Neustadt

[57] ABSTRACT

A drill string component for preventing chafing of a drill casing as a result of contact between the drill casing and a rotating drill string comprises a central mandrel (2) having rotatably mounted thereon a sleeve (11). The sleeve (11) is retained between shoulders defined on the mandrel to prevent accidental loss of the sleeve in the event of excessive wear in the supporting bearings. Axial thrust loads are transferred from the outer sleeve (11) to the mandrel by way of thrust bearings supported on the mandrel shoulders. Seals (24A, 24B) located between the outer sleeve seal bodies (23) and an inner sleeve (9) prevent the ingress of contaminants to the zone of bushings (12, 13) which rotatably support the outer sleeve.

7 Claims, 2 Drawing Sheets

DRILL STRING COMPONENT

Figure 1:
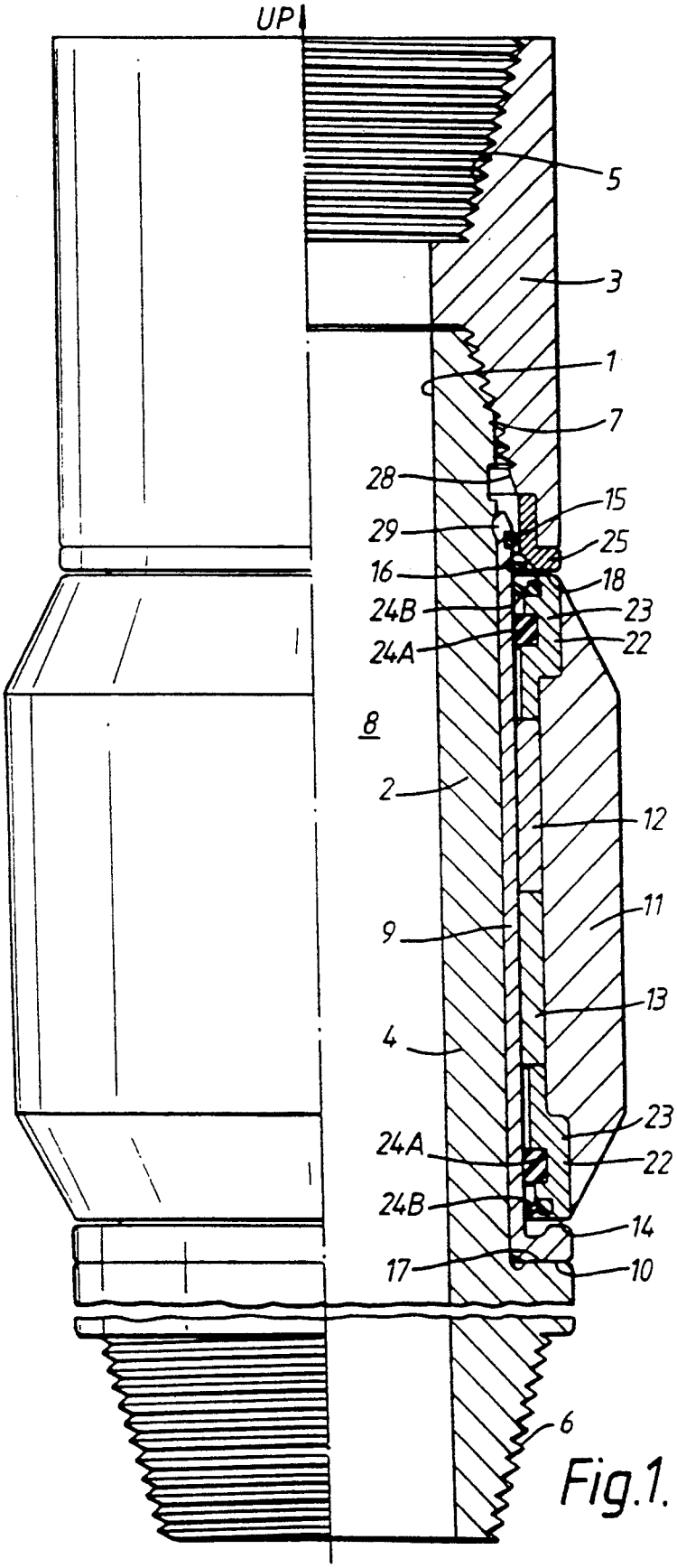

This invention relates to a drill string component, that is a component which, in use, forms part of a drill string for drilling a subterranean well, for example an oil or gas well.

It is conventional in drilling deep subterranean wells to line at least the upper regions of the well with a metal casing. The drill string used for drilling a well is made up of a number of sections interconnected by screw threaded joints and during drilling operations the joints are liable to beat against the casing. During prolonged periods of drilling this can lead to damage to the casing. The problem is particularly acute in the case of wells which deviate from the vertical and in cases where the rate of penetration of the drill string is slow so that one particular joint will beat against the same region of casing for a prolonged period. In extreme cases, the prolonged contact of the tool joint against the casing will damage the casing to the extent that it will be unable to withstand the designed operating pressures.

In an attempt to alleviate this problem it is known to apply an elastomeric protector around the drill string in order to protect the casing from the effects referred to above. However, elastomeric protectors are liable to deteriorate with the result that the elastomeric material may creep away from the joint and allow the joint to beat against the casing as described above. Further, elastomeric protectors of this type are inconvenient in use since they must be assembled onto the drill string as the drill string is made up at the surface of the well.

It is an object of the present invention to provide a drill string component which will reduce or eliminate wear on the casing resulting from rotary contact between the tool joints and the casing for prolonged periods.

According to one aspect of the present invention there is provided a drill string component adapted to form part of a drill string, the drill string component being provided at opposite ends thereof with threaded connections for connection to adjacent components of the drill string and being provided intermediate the ends thereof with a sleeve which is freely rotatably mounted on the remainder of the drill string component and has an outside diameter larger than that of any other part of the drill string component whereby if the drill string component abuts the wall of a well during a drilling operation the sleeve will rest against the wall of the well and rotatably support the remainder of the drill string component out of contact with the well wall.

The drill string component of the present invention may be embodied as a sub for insertion between two adjacent elements of the drill string, or may be embodied as a standard length of drill pipe. Each drill string component according to the invention may be provided with a single sleeve or, if desired, may be provided with a multiplicity of sleeves at various points along its length.

Preferably, the sleeve is retained on the remainder of the drill string component between a pair of opposing shoulders whereby the sleeve will be retained on the components even after extensive wear to the various elements of the component.

In a particularly preferred embodiment of the invention a sub is provided having a central mandrel which is formed as two parts which are screw threadedly interconnected in the zone of the sleeve. In this way, the mandrel parts may be unscrewed from each other to permit removal of the sleeve and any supporting bearings from the sub for service purposes.

Figure 2:
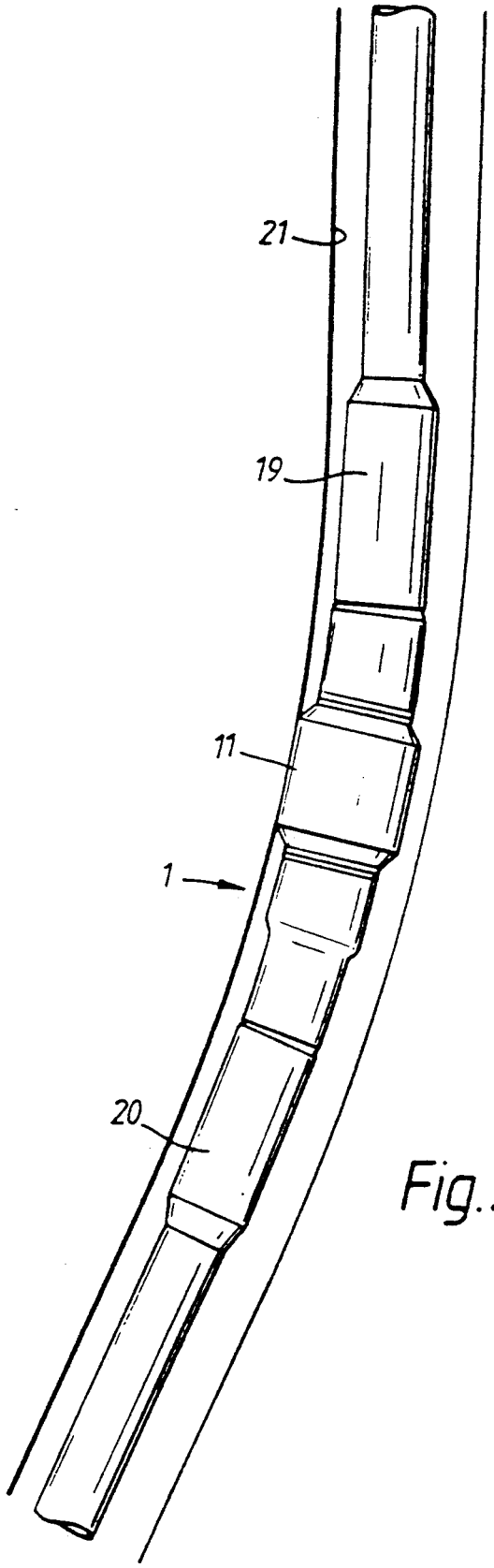

The invention will be better understood from the following description of a preferred embodiment thereof, given by way of example only, reference being had to the accompanying drawings wherein:

FIG. 1 is a schematic half-section view of a drill string component according to the present invention; and FIG. 2 illustrates the drill string component of FIG. 1 incorporated within a drill string extending through a deviated cased well.

Referring firstly to FIG. 1 there is illustrated an embodiment of the present invention embodied as a sub 1 for incorporation in a drill string between adjacent lengths of drill pipe, or between a length of drill pipe and a well tool. The sub 1 includes a central mandrel 2 comprising an upper mandrel part 3 and a lower mandrel part 4. The upper mandrel part 3 incorporates a conventional female thread 5 for connection to an adjacent tool or drill pipe and the lower mandrel part 4 incorporates a conventional male thread 6 for connection to an adjacent drill pipe or tool. In use, the mandrel parts 3,4 are interconnected by way of a screw threaded connection 7. When assembled together the mandrel defines a through passage 8 which communicates with the through passages of adjacent drill pipes or tools.

An inner sleeve 9 is mounted on the lower mandrel part 4 with a shoulder 10 at the bottom of the sleeve in abutting contact with a corresponding shoulder 17 provided on the lower mandrel part 4. The inner sleeve is mounted in a manner which prevents rotational and axial movement of the sleeve relative to the lower mandrel part. The inner sleeve may be secured to the lower mandrel by any convenient means and in the illustrated embodiment the inner sleeve is provided with an upset 29 which engages a corresponding recess on the lower mandrel part. Additionally or alternatively suitable pins or keys may be provided to lock the inner sleeve to the lower mandrel part. Additionally or alternatively the axial length of the inner sleeve may be increased so that the upper end of the inner sleeve abuts the downwardly facing surface 28 of the upper mandrel part 3.

An outer sleeve 11 is rotatably mounted on the inner sleeve 9 by way of bushings 12,13. In the illustrated embodiment of the invention the bushings 12,13 are push fitted within the outer sleeve 11 and are fixed relative to the outer sleeve. Seal assemblies 22 are push fitted within the outer sleeve 11 after the bushings 12,13 have been positioned. Each seal assembly 22 comprises a body 23 carrying inner and outer seals 24A and 24B which engage the outer surface of the inner sleeve 9 to prevent ingress of contaminants to the zone of the bushings 12,13 and to retain lubricant in the zone of the bushings. The outer sleeve 11 complete with bushings 12 and 13 and seal assemblies 22 is rotatable about the inner sleeve 9.

During fabrication of the drill string component, after the inner sleeve 9 has been located on the lower mandrel part 4 and fixed in position the outer sleeve 11 complete with bushings 12 and 13 and seal assemblies 22,23 is lowered onto the inner sleeve 9 until a thrust surface 14 provided by the seal assembly 22 engages a corresponding thrust face provided by a radially outwardly directed flange at the lower end of the inner sleeve 9. A spring clip 16 is positioned in a groove provided on the inner sleeve 9 to maintain the components in the assembled condition and an O-ring seal 15 is positioned in a retaining groove at the upper end of the inner sleeve. The upper mandrel part 3 is then screwed onto the lower mandrel part 4 and the O-ring seal 15 prevents the ingress of contaminants to the zone of the screw threaded connection between the upper and lower mandrel parts.

The outside diameter of the upper mandrel part 3 corresponds to the outside diameter of the lower mandrel part 4 at a point below the shoulder 10, and accordingly when the mandrel parts have been screwed together the inner sleeve 9 and all the components mounted thereon are held captive between the shoulder 17 of the lower mandrel part and the lower end face 18 of a thrust washer 25 which forms the lower extremity of the upper mandrel part.

The sleeve 11 is substantially symmetrically supported as regards axial thrust loading, downward axial thrust loading on the outer sleeve 11 being transferred to the lower mandrel part via the body 22 of the lower seal assembly and the flange 10 of the inner sleeve 9, and upward axial thrust forces being transmitted to the upper mandrel part 3 via the body 22 of the upper seal assembly and the thrust washer 25.

In use and with reference to FIG. 2, the illustrated sub 1 is positioned in a drill string between two other components of the drill string, for example an upper drill pipe 19 and a lower drill pipe 20 disposed in a deviant bore hole 21 lined with a metal casing (not shown). The outside diameter of the outer sleeve may be less than the diameter of the bore hole as shown in FIG. 2. In the event that the sub 1 comes into contact with the wall of the bore hole 21 the outer sleeve 11 will be the first component of the sub to contact the wall. Frictional engagement between the outer sleeve 11 and the wall of the well will hold the sleeve 11 against rotation, and the mandrel 2 will be rotatably supported by the sleeve 11 and bushings 12,13. In this manner, abrasive wear of the wall of the well will be prevented.

It will be appreciated that if desired the bushings 12,13 may be replaced by any suitable bearing arrangement, for example ball, roller, or taper roller bearings.

In addition to eliminating the problem of casing damaged outlined in the opening paragraphs of this specification use of the invention may enable drilling to be carried out using a drilling mud having less effective lubrication properties than that previously required for operation of drill strings in deviated bore holes. This may result in substantial cost savings and a reduction in pollution problems associated with the use of oil based muds. Use of the invention will, of course, produce a reduction in torque loss as a result of drill string contact with the wall of the well casing.

Although the invention has been described in relation to a component specifically manufactured to effect the desired support of a drill string, a drill string component can be provided to effect the desired support by mounting a suitable sleeve on an existing component for rotation relative to that component. If a drill string component is provided in this manner an inner sleeve generally as described above can be clamped to the outer surface of the existing component to provide the necessary support for the outer sleeve.

We claim:

1. A drill string component adapted to form part of a drill string for operating in a bore hole, the drill string component comprising a mandrel having a bore therethrough and being provided at opposite ends thereof with threaded connections for connection of adjacent components of the drill string, and being provided intermediate the ends thereof with an outer sleeve which is freely rotatably mounted on the mandrel and has an outside diameter larger than that of any other part of the drill string component and with an inner sleeve fixed to the mandrel to form a bearing surface for rotatably supporting the outer sleeve, the inner sleeve having an integral radially outwardly extending flange at one extremity thereof, the flange providing a first thrust bearing for one end of the outer sleeve for receiving axial thrust loads in one direction from the outer sleeve, a second thrust bearing being provided for the opposite end of the outer sleeve, the second thrust bearing being provided on the mandrel; whereby if the drill string component abuts the wall of a well during a drilling operation the outer sleeve will non-rotatably rest against the wall of the well and rotatably support the remainder of the drill string component out of contact with the well wall, said outer sleeve having a diameter less than said bore hole, said inner and outer sleeves being disposed between a pair of oppositely directed faces provided on the mandrel so that the sleeves will be retained even after extensive wear of the elements of the component, and seals at the opposite ends of the outer sleeve and sealingly engaging the inner sleeve to prevent the ingress of contaminants to the bearing surface for said outer sleeve and defined by said inner sleeve.

2. A drill string component according to claim 1, wherein the drill string component is a sub for insertion between two adjacent elements of the drill string.

3. A drill string component according to any preceding claim, wherein the mandrel is formed as two parts which are screw threadedly interconnected in the zone of the sleeve whereby the mandrel parts may be unscrewed from each other to permit removal of the sleeves and any supporting bearings for service purposes.

4. A drill string component according to claim 3, wherein the inner sleeve is fixed to one of the mandrel parts.

5. A drill string component according to claim 4, wherein the second thrust bearing is provided on the mandrel part which does not carry the inner sleeve.

6. A drill string component according to claim 6, wherein thrust bearing surfaces are provided on the outer sleeve by bodies of seal assemblies which are located at opposite extremities of the outer sleeve.

7. A drill string component according to claim 1, wherein a seal is provided between the inner sleeve and the thrust bearing mounted on the mandrel part which does not carry the inner sleeve, to prevent the ingress of contaminants to the screw threaded joint between the mandrel parts.

* * * * *